US011637386B2

(12) United States Patent
Hara et al.

(10) Patent No.: US 11,637,386 B2
(45) Date of Patent: Apr. 25, 2023

(54) TERMINAL AND TERMINAL WIRE ASSEMBLY

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP); TOYOTA JIDOSHA KABUSHIKI KAISHA, Toyota (JP)

(72) Inventors: Teruo Hara, Yokkaichi (JP); Hajime Kawase, Yokkaichi (JP); Masaaki Tabata, Yokkaichi (JP); Hajime Matsui, Yokkaichi (JP); Hiroshi Kobayashi, Okazaki (JP); Takeshi Amakawa, Toyota (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 23 days.

(21) Appl. No.: 17/613,608

(22) PCT Filed: Jun. 1, 2020

(86) PCT No.: PCT/JP2020/021595

§ 371 (c)(1),
(2) Date: Nov. 23, 2021

(87) PCT Pub. No.: WO2020/250733

PCT Pub. Date: Dec. 17, 2020

(65) Prior Publication Data

US 2022/0239019 A1 Jul. 28, 2022

(30) Foreign Application Priority Data

Jun. 12, 2019 (JP) ..... JP2019-109704

(51) Int. Cl.
*H01R 4/50* (2006.01)
*H01R 4/18* (2006.01)
*H01R 13/11* (2006.01)

(52) U.S. Cl.
CPC ..... *H01R 4/50* (2013.01); *H01R 4/18* (2013.01); *H01R 13/11* (2013.01)

(58) Field of Classification Search
CPC ..... H01R 4/50; H01R 4/5075; H01R 4/5083; H01R 4/5041; H01R 4/505
See application file for complete search history.

(56) References Cited

U.S. PATENT DOCUMENTS 4,597,622 A 7/1986 Coe
7,306,495 B2 12/2007 Hashimoto et al.
(Continued)

FOREIGN PATENT DOCUMENTS

JP S61-223656 A 10/1986
JP H04-147580 A 5/1992
(Continued)

OTHER PUBLICATIONS

Aug. 11, 2020 International Search Report issued in International Patent Application No. PCT/JP2020/021595.

*Primary Examiner* — Ross N Gushi
(74) *Attorney, Agent, or Firm* — Oliff PLC

(57) ABSTRACT

A terminal coupled to an electric wire includes a terminal body and a shell. The shell includes a tubular portion and pressing portions 25A and 25B that protrudes from an inner wall of the tubular portion. The tubular portion includes a bottom wall, a first sidewall that projects upward from a first side edge of the bottom wall, a second sidewall that projects
(Continued)

upward from a second side edge of the bottom wall, a ceiling that extends from the first sidewall to the second sidewall and is opposite the bottom wall, and a restricting portion that extends from the second sidewall to the first sidewall and overlaps an outer surface of the ceiling.

9 Claims, 12 Drawing Sheets

(56) References Cited

U.S. PATENT DOCUMENTS

| | | | | |
|---|---|---|---|---|
| 10,944,187 | B2 * | 3/2021 | Takeuchi | H01R 4/188 |
| 11,152,718 | B2 * | 10/2021 | Miyamura | H01R 4/5083 |
| 11,165,172 | B2 * | 11/2021 | Miyamura | H01B 7/00 |
| 11,228,152 | B2 * | 1/2022 | Miyamura | H01R 31/06 |
| 11,394,136 | B2 * | 7/2022 | Takeuchi | H01R 13/4361 |
| 2005/0026515 | A1 | 2/2005 | Hashimoto et al. | |
| 2020/0266556 | A1 * | 8/2020 | Takeuchi | H01R 13/10 |
| 2020/0287315 | A1 | 9/2020 | Miyamura et al. | |
| 2021/0234286 | A1 * | 7/2021 | Miyamura | H01R 13/02 |
| 2022/0181796 | A1 * | 6/2022 | Takeuchi | H01R 4/5075 |
| 2022/0224037 | A1 * | 7/2022 | Wi | H01R 4/10 |
| 2022/0231434 | A1 * | 7/2022 | Takeuchi | H01R 4/50 |
| 2022/0239018 | A1 * | 7/2022 | Takeuchi | H01R 4/305 |
| 2022/0247109 | A1 * | 8/2022 | Hara | H01R 13/26 |
| 2022/0255245 | A1 * | 8/2022 | Jo | H01R 4/28 |
| 2022/0263261 | A1 * | 8/2022 | Jo | H01R 4/5075 |
| 2022/0352665 | A1 * | 11/2022 | Jo | H01R 11/11 |
| 2022/0368040 | A1 * | 11/2022 | Wi | H01R 4/5083 |

FOREIGN PATENT DOCUMENTS

| | | | |
|---|---|---|---|
| JP | 2005-050736 | A | 2/2005 |
| JP | 2013-069497 | A | 4/2013 |
| JP | 2014-222650 | A | 11/2014 |
| JP | 2019-075328 | A | 5/2019 |
| JP | 2019-079674 | A | 5/2019 |

* cited by examiner

TERMINAL AND TERMINAL WIRE ASSEMBLY

BACKGROUND ART

A known terminal wire assembly includes a core wire exposed at an end of the electric wire and a terminal coupled to the core wire. The terminal may include a crimping portion that is crimped on a section of the core wire that is exposed at the end of the electric wire.

To crimp the terminal on the core wire, the following steps may be performed. A sheet metal is pressed into a predefined shape to prepare the terminal. The terminal is placed on a lower die of dies that are movable relative to each other in the vertical direction. The section of the core wire exposed at the end of the electric wire is placed on the crimping portion of the terminal. The one of the dies or both dies are moved closer to each other. The crimping portion of the terminal is crimped on the section of the core wire by pressing the crimping portion of the terminal with a crimping portion of the upper die and a placing portion of the lower die. Through these steps, the terminal is coupled to the end section of the electric wire (see Patent Document 1).

RELATED ART DOCUMENT

Patent Document

Patent Document 1

Japanese Unexamined Patent Application Publication No. 2005-50736

SUMMARY OF THE INVENTION

Problem to be Solved by the Invention

If a terminal that includes a terminal body and a shell is used, the electric wire is sandwiched between a holding portion of the terminal body and the shell that is on the holding portion instead of using the crimping portion described above. In such a configuration, the holding portion is pressed toward the electric wire by the shell to couple the terminal to the electric wire. The shell needs to be restricted from opening due to a reaction force of the electric terminal.

The technology described herein was made in view of the above circumstances. An object is to provide a terminal including a shell that is restricted from opening.

Means for Solving the Problem

A terminal described herein is coupled to an electric wire. The terminal includes a terminal body and a shell. The terminal body includes a holding portion that holds the electric wire. The shell includes a tubular portion that covers the holding portion and a pressing portion that protrudes from an inner wall of the tubular portion to press the holding portion toward the electric wire. The tubular portion includes a bottom wall, a first sidewall, a second sidewall, a ceiling, and a restricting portion. The first sidewall projects upward from a first side edge of the bottom wall. The second sidewall projects upward from a second side edge of the bottom wall. The ceiling extends from the first sidewall to the second sidewall. The ceiling is opposite the bottom wall. The restricting portion extends from the second sidewall toward the first sidewall and overlaps an outer surface of the ceiling.

Advantageous Effects of Invention

According to the present disclosure, the shell is less likely to open.

MODES FOR CARRYING OUT THE INVENTION

Figure 1:
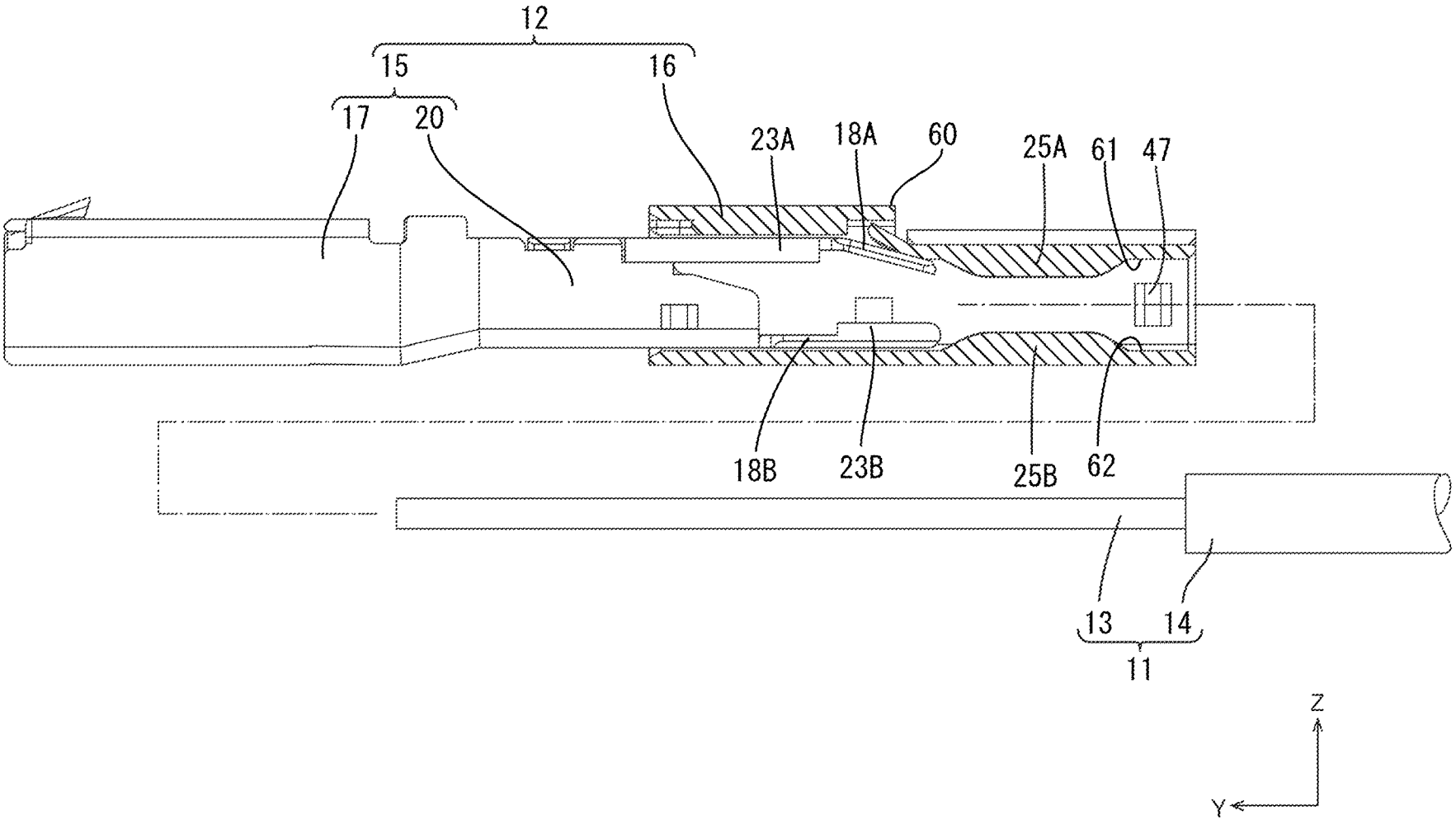
FIG. 1 is an exploded perspective view of a terminal wire assembly according to the present disclosure.

Description of Embodiments According to the Present Disclosure

First, embodiments of embodiments according to the present disclosure will be listed and described.

(1) A terminal described herein is coupled to an electric wire. The terminal includes a terminal body and a shell. The terminal body includes a holding portion that holds the electric wire. The shell includes a tubular portion that covers the holding portion and a pressing portion that protrudes from an inner wall of the tubular portion to press the holding portion toward the electric wire. The tubular portion includes a bottom wall, a first sidewall, a second sidewall, a ceiling, and a restricting portion. The first sidewall projects upward from a first side edge of the bottom wall. The second sidewall projects upward from a second side edge of the bottom wall. The ceiling extends from the first sidewall to the second sidewall. The ceiling is opposite the bottom wall. The restricting portion extends from the second sidewall toward the first sidewall and overlaps an outer surface of the ceiling.

Because pressing portion protrudes from the inner wall of the tubular portion, a large force is applied to the tubular portion by the electric wire via the pressing portion. Because the force is applied to the tubular portion from an inner side to an outer side, the tubular portion may open. According to the present disclosure, the pressing portion presses the ceiling from the outer side. Even if an outward force is applied to the ceiling to open upward by the electric wire, the ceiling is less likely to open.

(2) The restricting portion may include a bending section that extends along the first sidewall and bends toward the bottom wall. The first sidewall may include a receiving recess that receives the bending section. The bending section may include fitting sections that are fitted to an opening edge of the receiving recess.

With the fitting sections fitted to the opening edge of the receiving recess, the bending section is less likely to move away from the bottom wall. Therefore, the restricting portion that incudes the bending section is less likely to move away from the bottom wall. Namely, the ceiling located inner than the restricting portion is further less likely to open.

(3) The fitting sections may protrude from sides of the bending section in a width direction of the bending section, respectively.

According to the configuration, forces to move the fitting sections away from the bottom wall are evenly received by the opening edge of the receiving recess in the width direction. Therefore, the restricting portion is less likely to deform in the width direction. Namely, reliability in electrical connection between the terminal and the electric wire is less likely to decrease.

(4) The ceiling may include a fitting tab that protrudes toward the second sidewall. The second sidewall may include a fitting hole that receives the fitting tab.

With the fitting tab fitted to a hole edge of the fitting hole, the second sidewall is less likely to deform to open.

(5) The pressing portion may protrude from a least one of the bottom wall and the ceiling.

The bottom wall or the ceiling from which the pressing portion protrudes to press the electric wire is further less likely to open.

(6) The shell may be slidable relative to the terminal body in a direction in which the electric wire extends.

According to the configuration, the terminal is coupled to the electric wire by sliding the shell, that is, with a simple method. This improves work efficiency in coupling of the terminal to the electric wire.

(7) A terminal wire assembly according to the present disclosure includes the terminal according to any one of above (1) to (6) and an electric wire coupled to the terminal.

Detail of Embodiment According to the Present Disclosure

Embodiments according to the present disclosure will be described. The present invention is not limited to the embodiments. All modifications within and equivalent to the technical scope of the claimed invention may be included in the technical scope of the present invention.

First Embodiment

A first embodiment according to the present disclosure will be described with reference to FIGS. 1 to 12. A terminal wire assembly 10 according to this embodiment includes a terminal 12 and an electric wire 11 to which the terminal 12 is coupled. In the following description, it is considered that an Z arrow, a Y arrow, and an X arrow in the drawing point the upper side the front side, and the left side, respectively. Regarding components having the same configuration, some of the components may be indicated by reference signs and others may not be indicated by the reference signs.

[Electric Wire 11]

As illustrated in FIG. 1, the electric wire 11 includes a core wire 13 and an insulating sheath 14 that covers an outer surface of the core wire 13. The insulating sheath 14 is made of synthetic resin having insulating properties. At an end of the electric wire 11, the insulating sheath 14 is ripped and a section of the core wire 13 is exposed. The core wire 13 in this embodiment is a single core wire including only one metal wire. Alternatively, a twisted wire including multiple metal fine wires that are twisted together may be used for the core wire 13. The metal of which the metal wire is made may be selected from any kinds of meatal including copper, copper alloy, aluminum, and aluminum alloy where appropriate. The core wire 13 in this embodiment may be made of copper or copper alloy.

[Terminal 12]

As illustrated in FIG. 1, the terminal 12 includes a terminal body 15 and a slider 16 (an example of a shell). The terminal body 15 is made of metal. The slider 16 is slidable relative to the terminal body 15.

[Terminal Body 15]

The terminal body 15 is formed into a predetermined shape by a known method including pressing, cutting, and casting. The metal of which the terminal body 15 is made may be selected from any kinds of metal including aluminum, aluminum alloy, and stainless steel where appropriate. The terminal body 15 in this embodiment may be made of copper or copper alloy. Surfaces of the terminal body 15 may be plated. The plating metal may be selected from any kinds of metal such as tin, nickel, and silver where appropriate. The terminal body 15 in this embodiment is tin-plated.

As illustrated in FIG. 1, the terminal body 15 includes a tubular coupling portion 17 and a wire coupling portion 20. A mating male terminal, which is not illustrated, is inserted into the tubular coupling portion 17. The wire coupling portion 20 is behind the tubular coupling portion 17 and coupled to the electric wire 11. The wire coupling portion 20 includes an upper holding section 18A and a lower holding section 18B that extend rearward.

As illustrated in FIG. 1, the tubular coupling portion 17 has a rectangular tubular shape and extends in the front-rear direction. The tubular coupling portion 17 has an opening through which the mating male terminal is inserted. An elastic contact tab, which is not illustrated, projects frontward from the rear section of the tubular coupling portion 17 inside the tubular coupling portion 17. When the mate terminal is inserted in the tubular coupling portion 17 and elastic contact is established between the mate terminal and the elastic contact tab, the tubular coupling portion 17 is electrically connected to the mate terminal.

As illustrated in FIG. 1, the wire coupling portion 20 is behind the tubular coupling portion 17. The wire coupling portion 20 has a rectangular tubular shape. The upper holding section 18A (an example of a holding section) projects rearward from a rear end portion of an upper wall of the wire coupling portion 20. The lower holding section 18B projects rearward from a rear end portion of a lower wall of the wire coupling portion 20. The upper holding section 18A and the lower holding section 18B have elongated shapes extending in the front-rear direction. Lengths of the upper holding section 18A and the lower holding section 18B measuring in the front-rear direction are about equal to each other.

An upper holding protrusion 23A protrudes downward from a section of a lower surface of the upper holding section 18A in front of a rear edge of the upper holding section 18A. A lower holding protrusion 23B protrudes upward from a section of an upper surface of a rear edge of the lower holding section 18B. The lower holding protrusion 23B is displaced from the upper holding protrusion 23A in the front-rear direction.

A lower surface of the upper holding section 18A and an upper surface of the lower holding section 18B dig into an oxide layer formed on the surface of the core wire 13 and locally strip the oxide layer so that the metal surface of the core wire 13 is exposed. With the metal surface contacting the upper holding section 18A and the lower holding section 18B, the core wire 13 is electrically connected to the terminal body 15.

[Slider 16]

As illustrated in FIG. 1, the slider 16 includes a tubular portion 60 having a rectangular tube shape that extends in the front-rear direction. A method of producing the slider 16 is not limited; however, the slider 16 is produced by pressing a metal sheet 70 in this embodiment. The metal of which the slider 16 is made may be selected from any kinds of metal including copper, copper alloy, aluminum, aluminum alloy, and stainless steel where appropriate. The slider 16 in this embodiment is made of stainless steel. Surfaces of the slider 16 may be plated. Metal used for plating may be selected from any kinds of metal including tin, nickel, and silver where appropriate.

Figure 2:
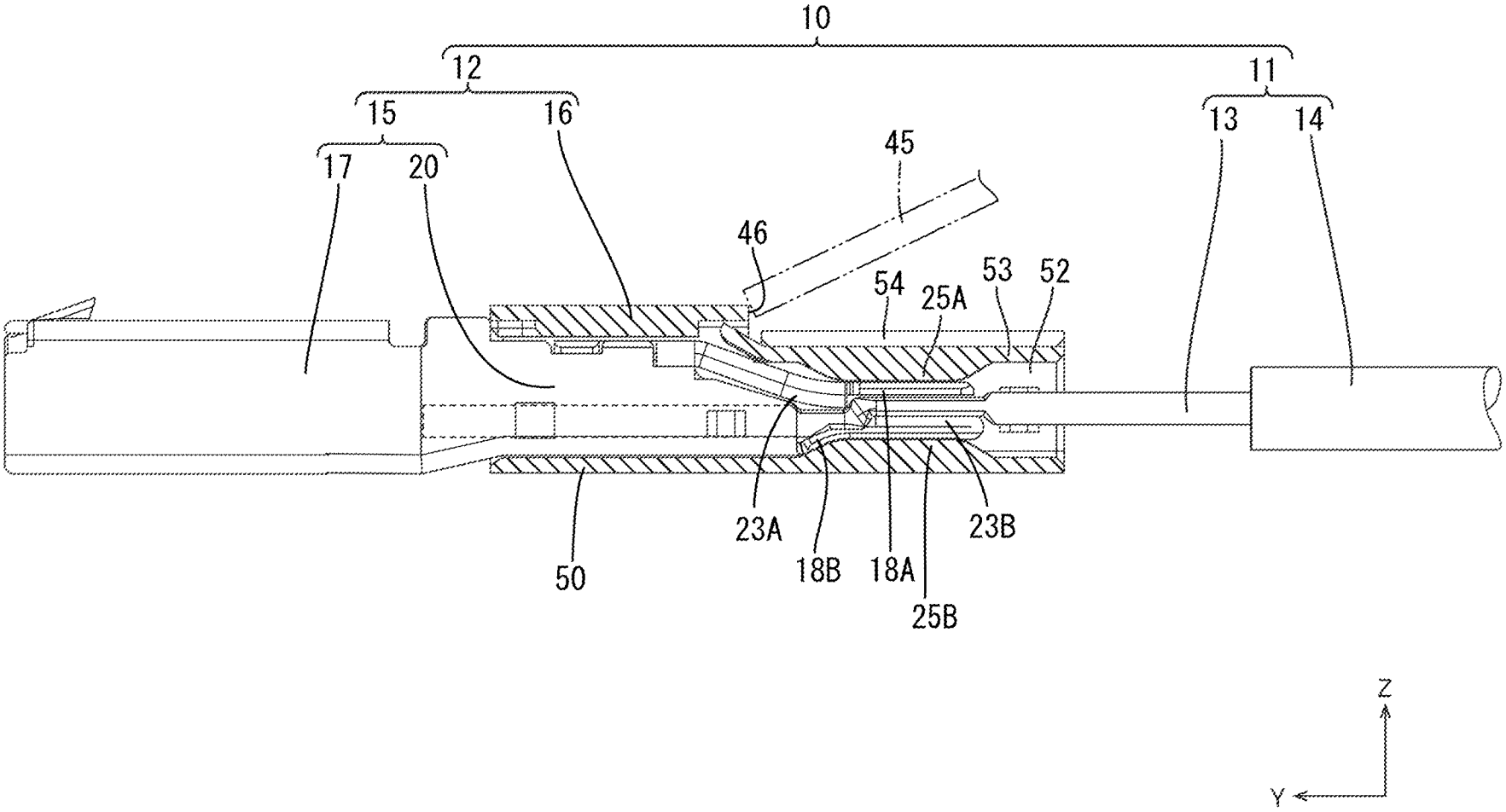
FIG. 2 is a cross-sectional view of the terminal wire assembly.

As illustrated in FIG. 2, the upper surface of the tubular portion 60 includes a front area that is more to the front than the middle in the front-rear direction and located higher than a rear area. According to the configuration, a step is provided in the top-bottom direction between an upper edge of the front section of the tubular portion 60 and an upper edge of the rear section of the tubular portion 60. The step is defined as a jig contact section 46 that contacts a jig 45, which will be described later.

Figure 3:
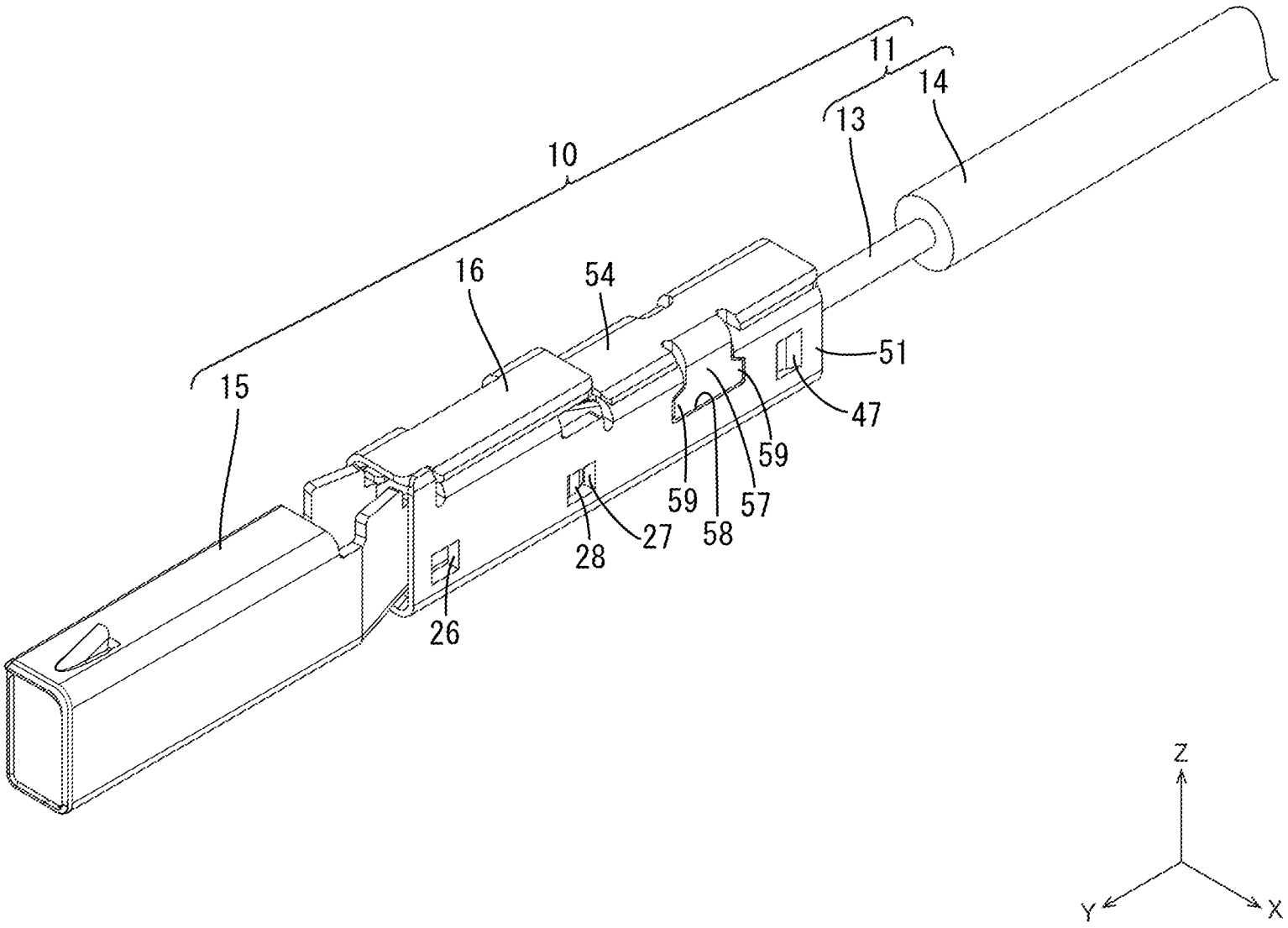
FIG. 3 is a perspective view of the terminal wire assembly.
Figure 4:
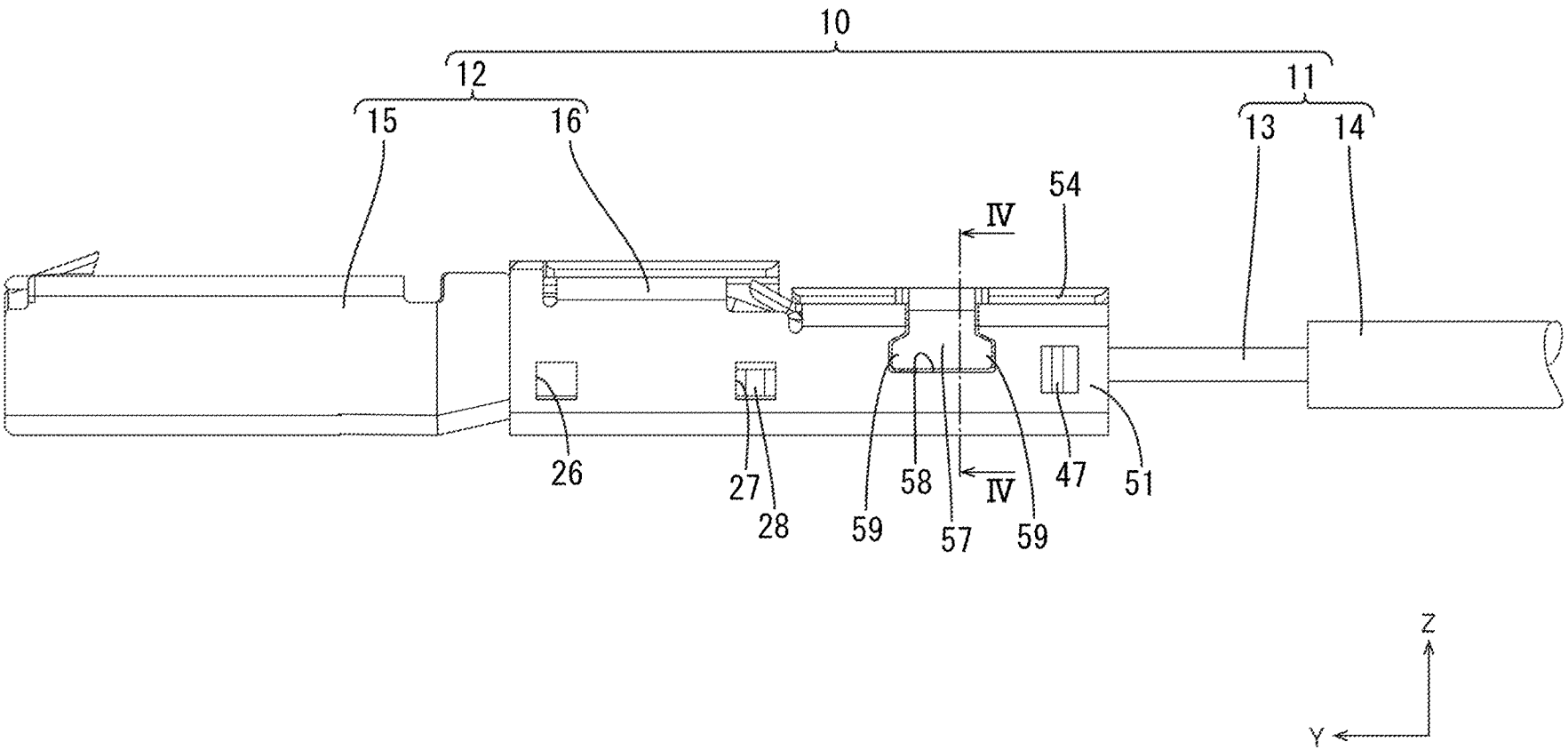
FIG. 4 is a left-side view of the terminal wire assembly.
Figure 5:
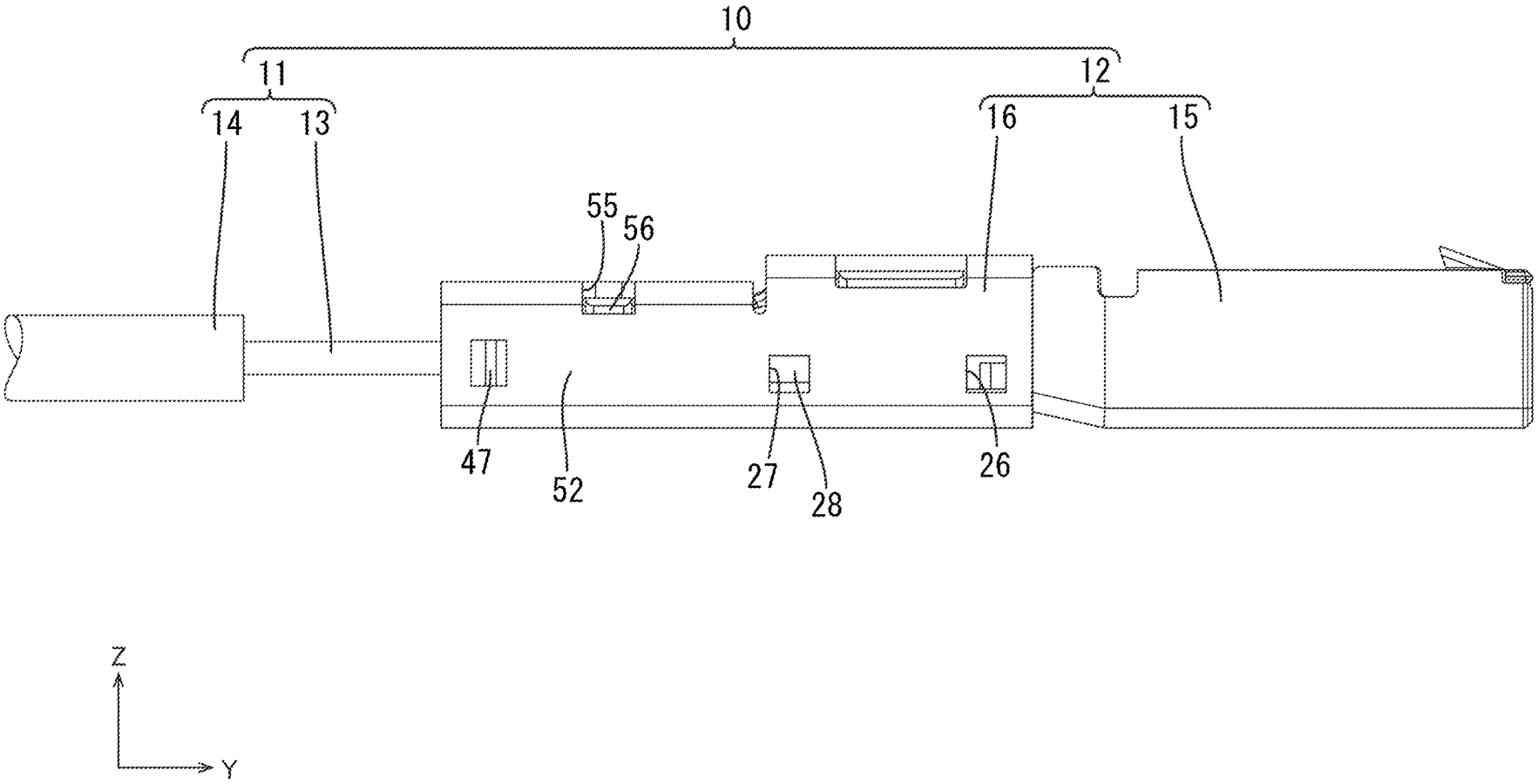
FIG. 5 is a right-side view of the terminal wire assembly.
Figure 6:
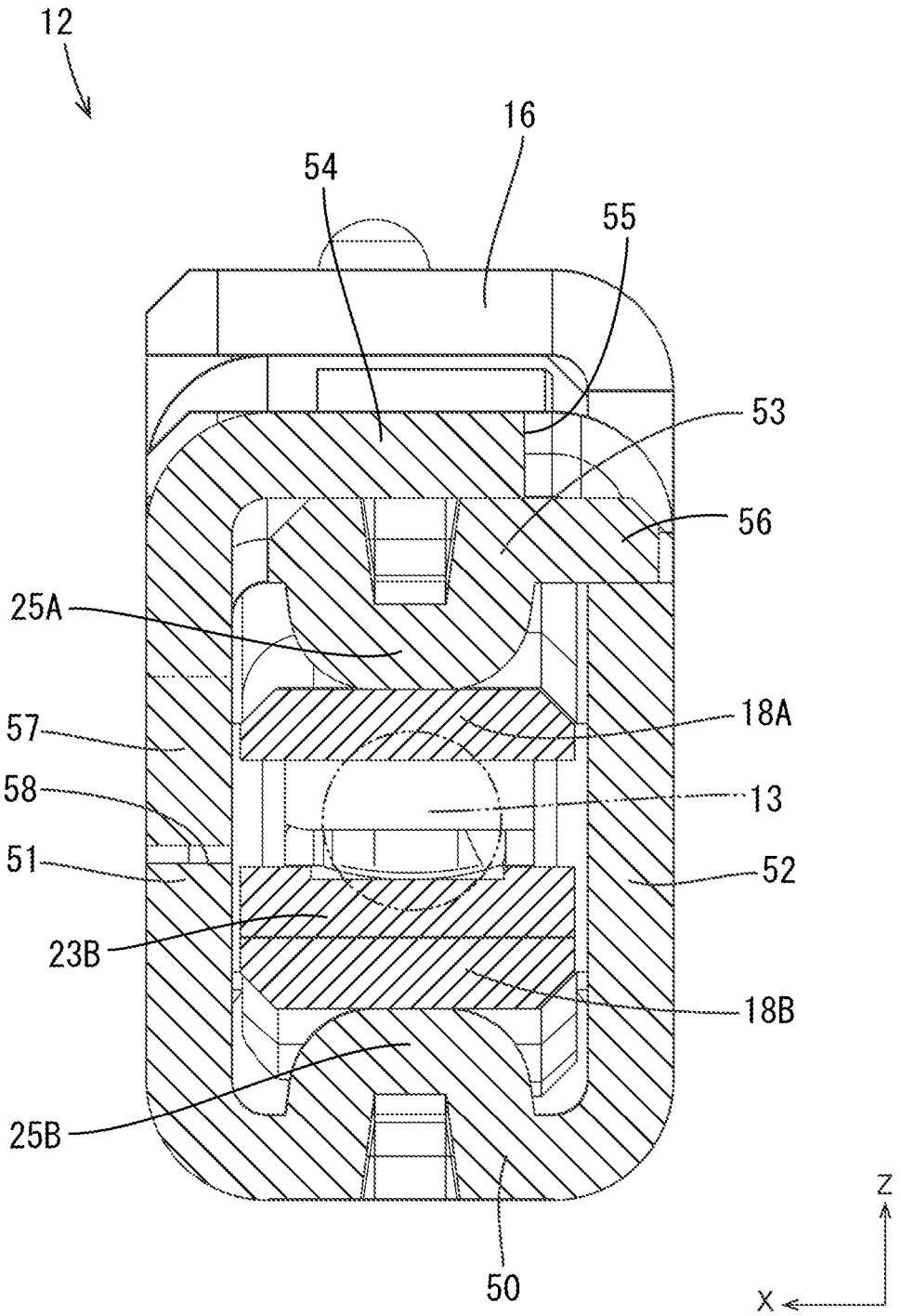
FIG. 6 is a cross-sectional view along line VI-VI in FIG. 4.

As illustrated in FIG. 2, the tubular portion 60 includes a bottom wall 50 that is elongated in the front-rear direction. As illustrated in FIGS. 3 and 4, the slider 16 includes a left wall 51 (an example of a first sidewall) that projects upward from a left edge of the bottom wall 50. As illustrated in FIG. 5, the tubular portion 60 includes a right wall 52 (an example of a second sidewall) that projects upward from a right edge of the bottom wall 50. As illustrated in FIG. 6, the tubular portion 60 includes a ceiling 53 and a restricting portion 54. The ceiling 53 bends rightward (toward the right wall 52) from an upper edge of the left wall 51. The ceiling 53 is opposite the bottom wall 50. The restricting portion 54 bends leftward (toward the left wall 51) from an upper edge of the right wall 52 and overlaps the ceiling 53 from above.

As illustrated in FIG. 1, the rear section of the tubular portion 60 includes an upper pressing portion 25A (an example of a pressing portion) that protrudes downward from a lower surface 61 (an example of an inner wall) of the ceiling 53. The tubular portion 60 includes a lower pressing portion 25B (an example of a pressing portion) that protrudes upward from an upper surface 62 (an example of an inner wall) of the bottom wall 50 of the tubular portion 60. A front surface of the upper pressing portion 25A and a front surface of the lower pressing portion 25B includes sloped surfaces. With the sloped surfaces, the rear end of the upper holding section 18A and the rear end of the lower holding section 18B are guided to the upper pressing portion 25A and the lower pressing portion 25B, respectively.

As illustrated in FIGS. 4 and 5, the left wall 51 and the right wall 52 of the tubular portion 60 include temporary receiving holes 26 at positions closer to the front edge. The left wall 51 and the right wall 52 of the tubular portion 60 include permanent receiving holes 27 behind the temporary receiving holes 26. The holding protrusions 28 on the sidewalls of the terminal body 15 can be elastically held in the temporary receiving holes 26 or the permanent receiving holes 27.

When the holding protrusions 28 of the terminal body 15 are held in the temporary receiving holes 26 of the tubular portion 60, the slider 16 is held at a temporary holding position relative to the terminal body 15 (see FIG. 1). At this position, the upper pressing portion 25A and the lower pressing portion 25B of the tubular portion 60 are separated rearward from the rear edges of the upper holding section 18A and the lower holding section 18B of the terminal body 15. Further, a gap between the upper holding section 18A and the lower holding section 18B is greater than the diameter of the core wire 13.

When the holding protrusions 28 of the terminal body 15 are held in the permanent receiving holes 27 of the tubular portion 60, the slider 16 is held at the permanent holding position relative to the terminal body 15 (see FIG. 2). At this position, the upper pressing portion 25A on the lower surface 61 of the ceiling 53 of the tubular portion 60 contacts the upper holding section 18A from above. Further, the lower pressing portion 25B on the upper surface 62 of the bottom wall 50 of the tubular portion 60 contacts the lower holding section 18B from below.

As described above, while the slider 16 is fitted on a section of the terminal body 15 including the upper holding section 18A and the lower holding section 18B, the slider 16 is slidable in the front-rear direction between the temporary holding position and the permanent holding position.

As illustrated in FIG. 2, when the slider 16 is held at the permanent holding position relative to the terminal body 15, the upper pressing portion 25A presses the upper holding section 18A and thus the upper holding section 18A deforms downward. Further, the lower pressing portion 25B presses the lower holding section 18B and thus the lower holding section 18B deforms upward. When the core wire 13 is disposed in a gap between the upper holding section 18A and the lower holding section 18B to extend in the front-rear direction (an extending direction) and the slider 16 is held at the permanent holding position relative to the terminal body 15, the core wire 13 is sandwiched between the upper holding section 18A and the lower holding section 18B that are deformed in the top-bottom direction. Namely, the upper holding section 18A that is pressed downward from above by the upper pressing portion 25A contacts the core wire 13 and the lower holding section 18B that is pressed upward from below by the lower pressing portion 25B contacts the core wire 13.

As illustrated in FIG. 2, when the slider 16 is held at the permanent holding position relative to the terminal body 15, the upper holding protrusion 23A of the upper holding section 18A presses the core wire 13 from above and the lower holding protrusion 23B of the lower holding section 18B presses the core wire 13 from below. The core wire 13 that is pressed from below by the upper holding protrusion 23A from above and the lower holding protrusion 23B that is displaced from the upper holding protrusion 23A in the front-rear direction. Therefore, the core wire 13 remain bent in the top-bottom direction (an example of a direction crossing the extending direction). With the upper holding protrusion 23A and the lower holding protrusion 23B, the core wire 13 is electrically connected to the terminal 12.

As illustrated in FIG. 2, the jig contact section 46 is in an upper section of the slider 16 at a border between the front section and the rear section of the slider 16. When the jig 45 contacts the jig contact section 46 from the rear, the slider 16 is pushed forward by the jig 45. That is, the slider 16 moves forward. The jig 45 is smaller than a die or equipment to move the die. Therefore, an increase in cost related to the jig 45 is less likely to occur.

As illustrated in FIG. 1, the tubular portion 60 includes two drawing sections 47 at a position closer to the rear edge of the tubular portion 60. The drawing sections 47 protrude from the right wall and the left wall to an inner side of the slider 16. The drawing sections 47 have a width that decreases from the rear side to the front side. With the core wire 13 sliding on inner surfaces of the drawing sections 47, the core wire 13 is guided into the slider 16.

[Opening Limiter Structure]

An opening limiter structure for limiting opening of the slider 16 will be described. As illustrated in FIG. 6, the restricting portion 54 is over the ceiling 53. The restricting portion 54 covers about an entire area of the upper surface of the ceiling 53. When a force is applied to the ceiling to open upward, the ceiling 53 is pressed by the restricting portion 54 and thus opening of the ceiling 53 upward is restricted.

As illustrated in FIG. 5, the slider 16 includes a fitting hole 55 that is a through hole in an upper edge area of the right wall 52 at the middle of the rear portion of the slider 16 in the front-rear direction. As illustrated in FIG. 6, the fitting hole 55 extends from the upper edge area of the right wall 52 to a right edge area of the restricting portion 54. A fitting tab 56 that protrudes from the right end of the ceiling 53 is inserted from the left side and fitted. The right end of the fitting tab 56 does not project rightward from the right wall 52. The fitting tab 56 is over a hole edge of the fitting hole 55. According to the configuration, when a force is applied to the right wall 52 to open rightward, the right wall 52 is pressed from above by the fitting tab 56. Therefore, opening of the right wall 52 rightward is restricted.

Figure 7:
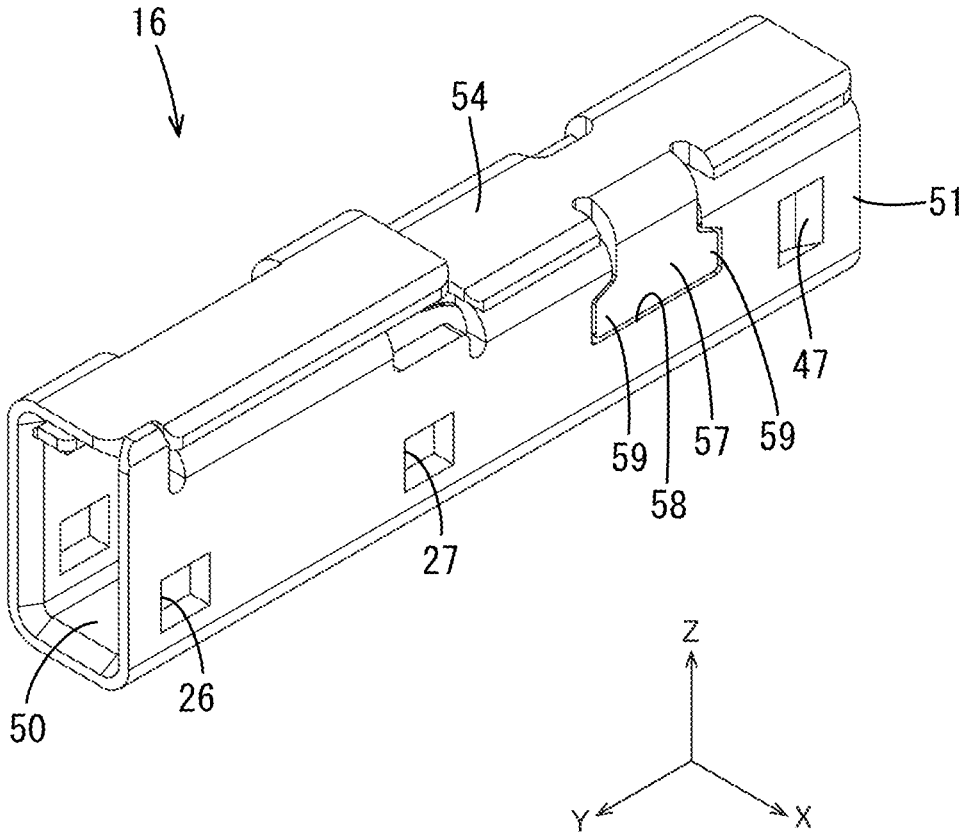
FIG. 7 is a perspective view of a slider.

As illustrated in FIG. 7, the slider 16 includes a receiving recess 58 at the middle of the rear portion of the slider 16 in the front-rear direction. The receiving recess receives a bending section 57, which will be described later. The receiving recess 58 extends from an upper edge section to a lower section of the left wall 51. In a left view, a lower portion of the receiving recess 58 is greater in the front-rear direction.

As illustrated in FIGS. 4 and 7, the bending section 57 is held in the receiving recess 58. An inner shape of the receiving recess 58 is slightly greater than an outer shape of the bending section 57. The bending section 57 bends downward from the right edge of the restricting portion 54. The lower section of the bending section 57 expands in the front-rear direction (an example of a width direction of the bending section 57). A sections projects frontward from the lower section of the bending section 57 and a section projects rearward from the lower section of the bending section 57 contact the opening edge of the receiving recess from below. This restricts the bending section 57 from moving upward. A section projecting frontward from the lower end of the bending section 57 and a section projecting rearward from the lower end of the bending section 57 are defined as fitting sections 59.

[Steps of Producing the Electric Cable 10 Including the Terminal]

Next, steps of producing the terminal wire assembly 10 will be described. The steps of producing the terminal wire assembly 10 are not limited to those described below.

The terminal body 15 is prepared by pressing sheet metal, which is not illustrated, with a known method.

Figure 8:
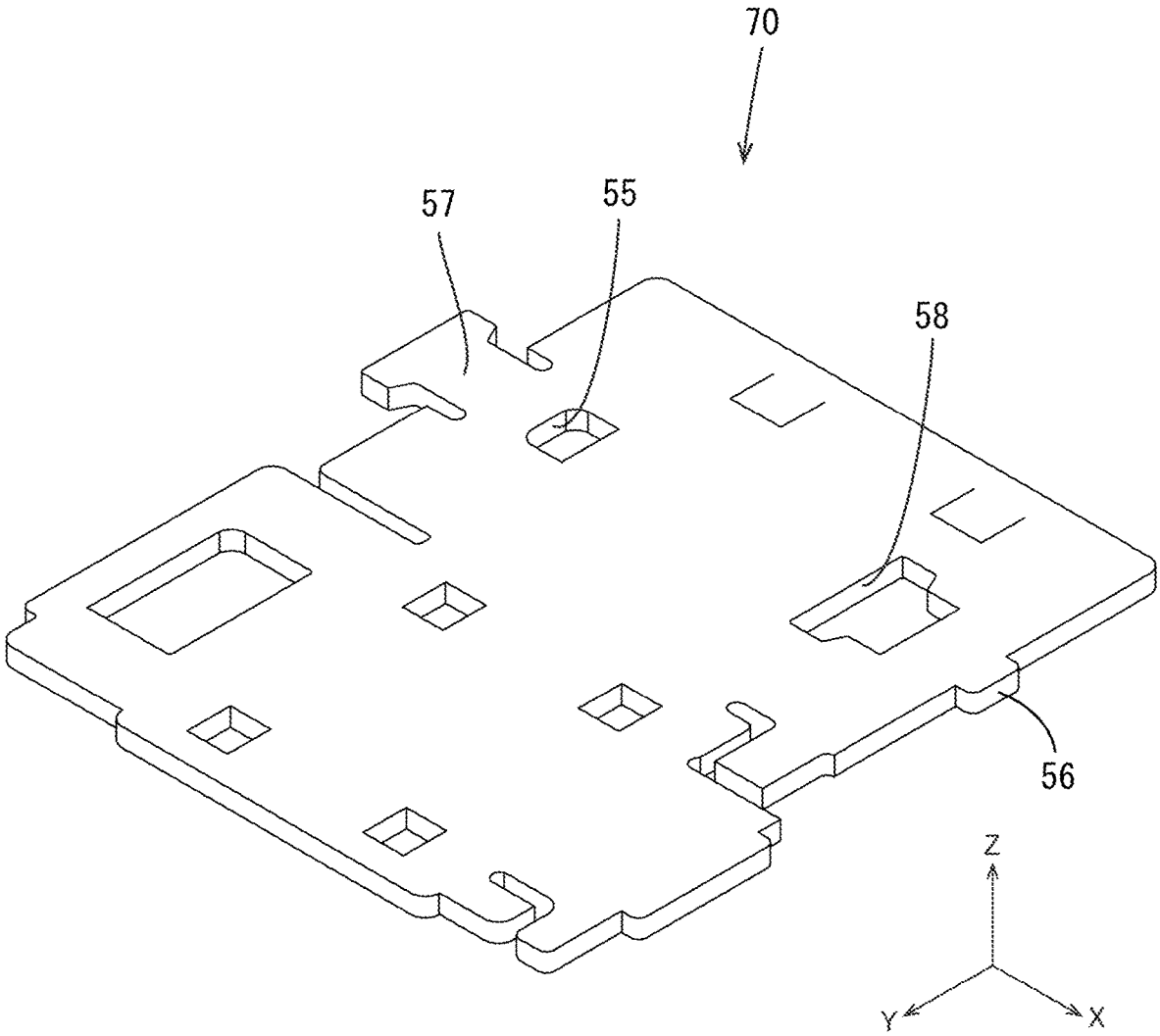
FIG. 8 is a perspective view of a metal sheet from which the slider is formed.
Figure 9:
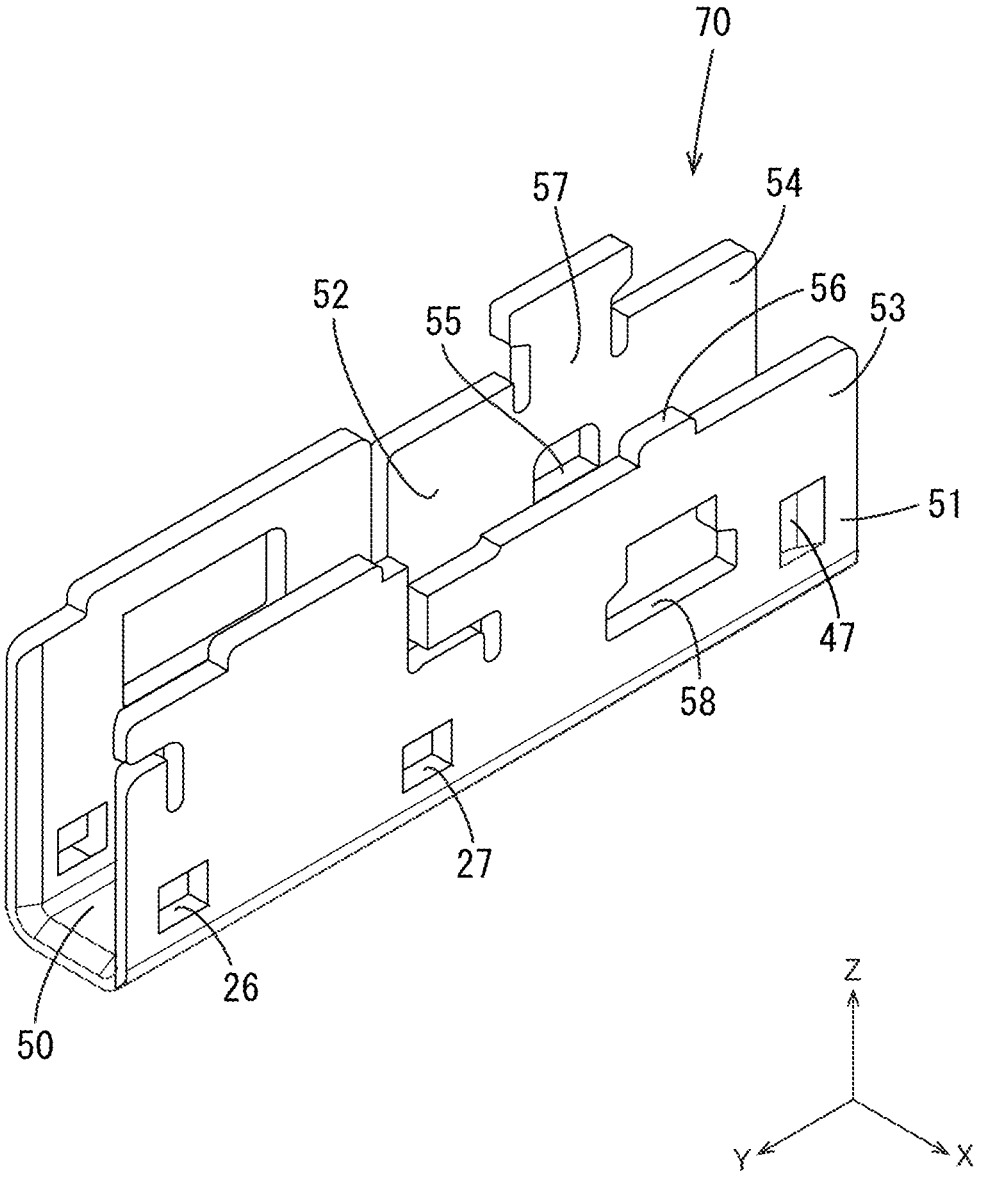
FIG. 9 is a perspective view of the metal sheet after a bottom wall, a left wall, and a right wall are formed by bending.

The metal sheet 70 in a shape illustrated in FIG. 8 is prepared by pressing. In FIGS. 8 and 9, the metal sheet is illustrated with a thickness that is greater than an actual thickness.

Figure 10:
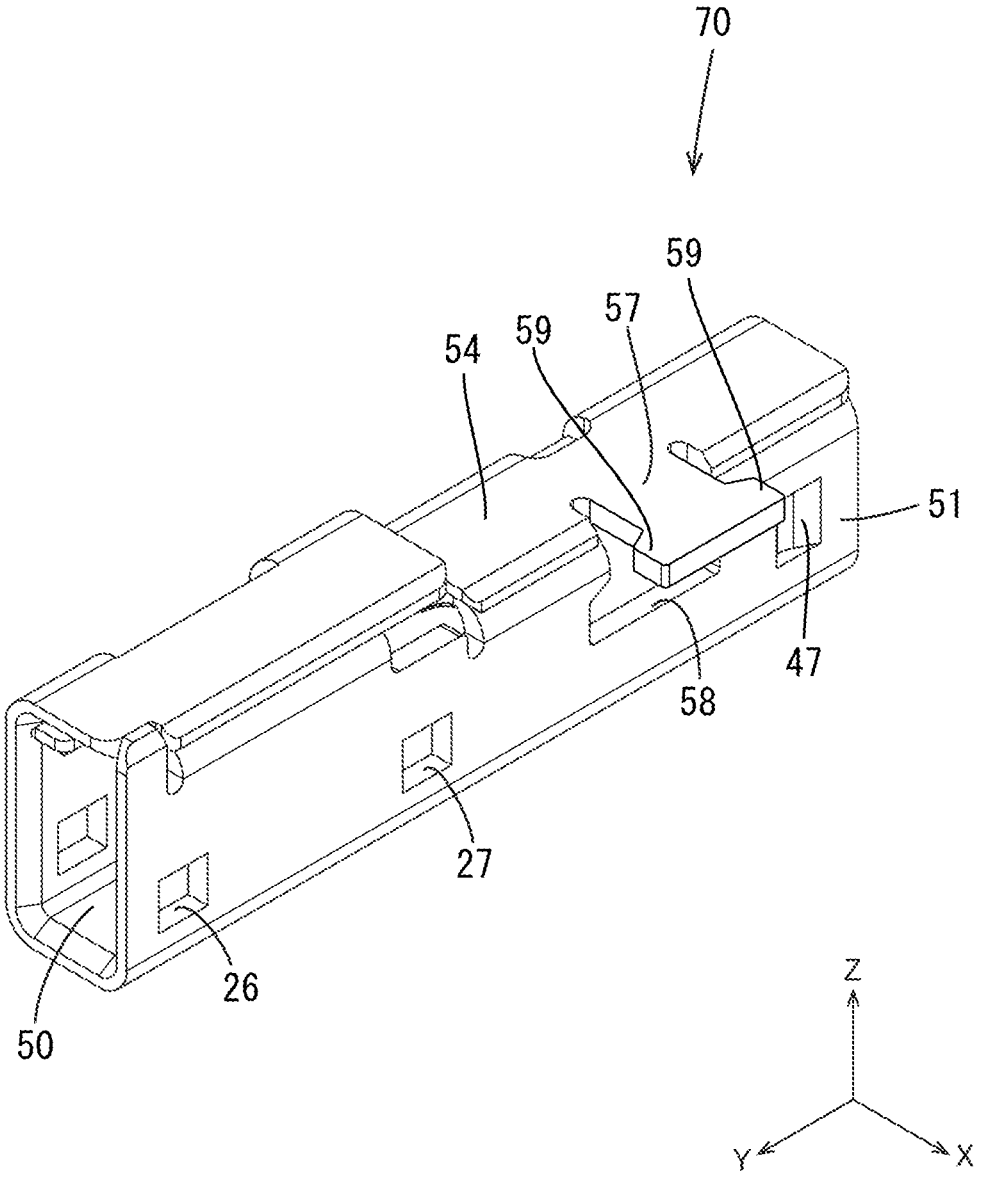
FIG. 10 is a perspective view illustrating a process before a bending section is bent.

As illustrated in FIG. 8, a left edge section and a right edge section of the bottom wall 50 are bent upward to form the left wall 51 and the right wall 52. Next, an upper edge section of the left wall 51 is bent rightward at the right angle to form the ceiling 53. As illustrated in FIG. 10, an upper edge section of the right wall 52 is bent leftward at the right angle to form the restricting portion 54 that is over the ceiling 53. The bending section 57 is then bent downward at the right angle and fitted in the receiving recess 58 (see FIG. 7). Although not illustrated in detail, the lower pressing portion 25B is formed at the bottom wall 50 and the upper pressing portion 25A is formed at the ceiling 53 in the formation of the slider 16. Through these steps, the slider 16 is prepared.

The slider 16 is attached to the terminal body 15 from the rear. The front edge of the slider 16 contacts the holding protrusions 28 of the terminal body 15 from the rear and the sidewalls of the slider 16 deform to expand. When the slider 16 is pushed further forward, the sidewalls of the slider 16 recover. As a result, the holding protrusions 28 of the terminal body 15 are fitted in the temporary receiving holes 26 of the slider 16 and the slider 16 is held at the temporary holding position relative to the terminal body 15. The terminal 12 is obtained (see FIG. 1).

The section of the core wire 13 of the electric wire 11 is exposed by striping the section of the insulating sheath with a known method. The front end of the core wire 13 is inserted into the slider 16 from the rear end of the slider 16. The core wire 13 is guided into the slider 16 with the drawing sections 47 of the slider 16 contacting the core wire 13. When the core wire 13 is pushed further forward, the front end of the core wire 13 enters the inside of the terminal body 15 and reaches the gap between the upper holding section 18A and the lower holding section 18B.

When the slider 16 is held at the temporary holding position relative to the terminal body 15, the gap between the upper holding section 18A and the lower holding section 18B is greater than the outer diameter of the core wire 13.

As illustrated in FIG. 2, the jig 45 is brought into contact with the jig contact portion 46 from the rear to slide the slider 16 frontward. The slider 16 is slid frontward relative to the terminal body 15. The holding protrusions 28 of the terminal body 15 are released from the temporary receiving holes 26 of the slider 16. The sidewalls of the slider 16 slide on the holding protrusions 28 and thus the sidewalls of the slider 16 deform to expand.

When the slider 16 is moved forward, the sidewalls of the slider 16 recover and the holding protrusions 28 of the terminal body 15 are elastically fitted in the permanent receiving holes 27 of the slider 16. As a result, the slider 16 is held at the temporary holding position relative to the terminal body 15.

With the slider 16 held at the permanent holding position relative to the terminal body 15, the upper pressing portion 25A of the slider 16 contacts the upper holding section 18A of the terminal body 15 from above and presses the upper holding section 18A downward. The lower pressing portion 25B of the slider 16 contacts the lower holding section 18B of the terminal body 15 from below and presses the lower holding section 18B upward. Therefore, the core wire 13 is sandwiched between the upper holding section 18A and the lower holding section 18B in the top-bottom direction (see FIG. 2).

As illustrated in FIG. 2, the core wire 13 is sandwiched between the lower surface of the upper holding section 18A and the upper surface of the lower holding section 18B. The oxide film on the surface of the core wire is striped and a metal surface of the core wire 13 is exposed. With the metal surface contacting the upper holding section 18A and the lower holding section 18B, the electric wire 11 is electrically contacted to the terminal 12.

When the core wire 13 is sandwiched between the upper holding section 18A and the lower holding section 18B in the top-bottom direction, the core wire 13 is sandwiched between the upper holding protrusion 23A on the upper holding section 18A and the lower holding protrusion 23B on the lower holding section 18B. The core wire 13 is stretched in the front-rear direction and bent in the top-bottom direction. According to the configuration, the core wire 13 is firmly held and thus the electric wire 11 and the terminal 12 are held together with a greater force even when the electric wire 11 is pulled. The terminal wire assembly 10 is complete.

[Description of Problems]

To describe operation and effects of this embodiment, a terminal 112 that does not include the restricting portion 54, the bending section 57, the fitting section 59, the fitting tab 56, and the fitting hole 55 according to a vertical technology will be described. Components of the terminal 112 corresponding to the components of the first embodiment will be indicated by reference signs that are defined by adding 100 to the reference signs of the corresponding components of the first embodiment.

Figure 11:
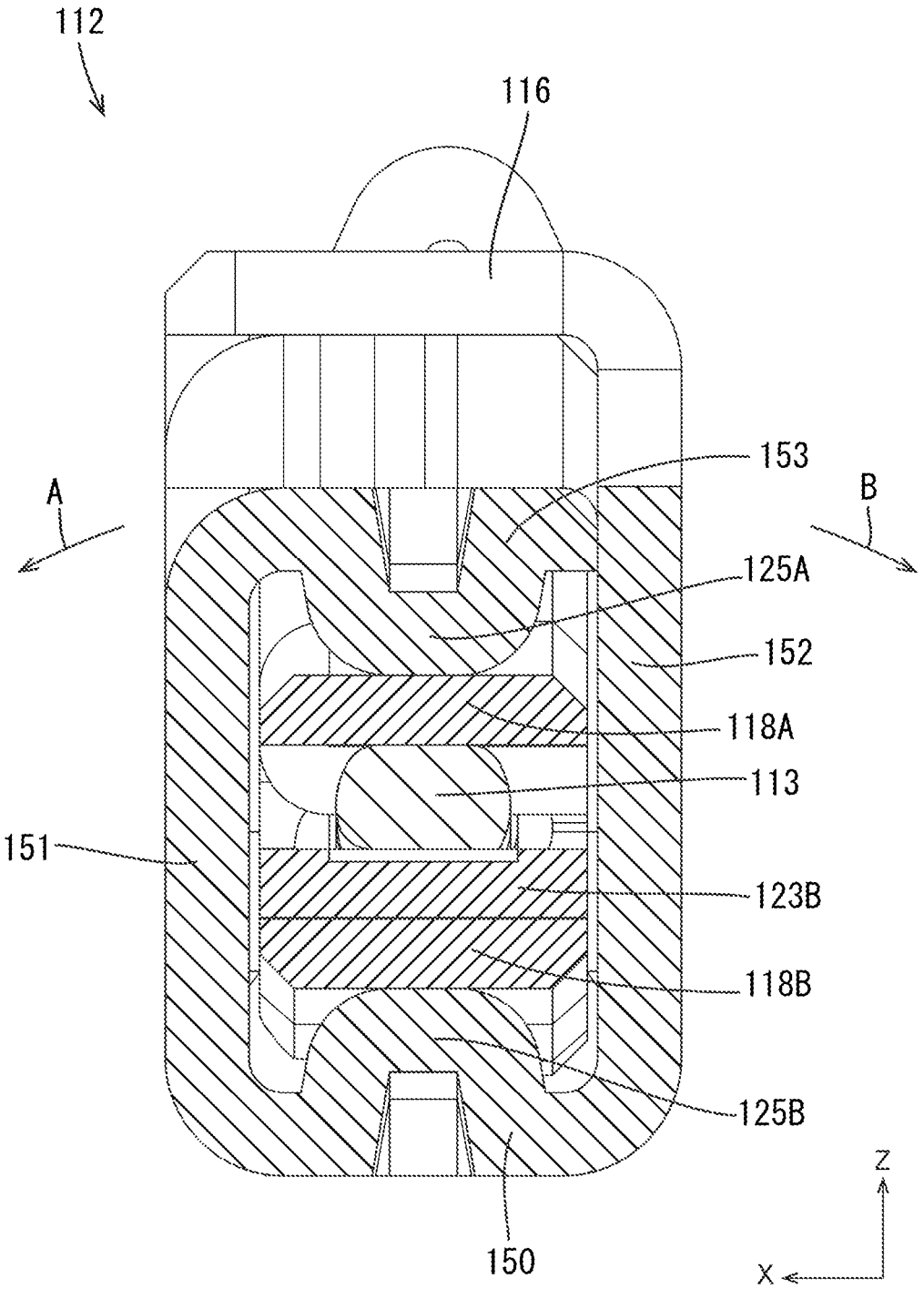
FIG. 11 is a cross-sectional view of a terminal according to a virtual technology.

As illustrated in FIG. 11, in the terminal 112 according to the virtual technology, when a core wire 113 is sandwiched between an upper holding section 118A and a lower holding section 118B, an upward force is applied to a ceiling 153 of a slider 116 and a downward force is applied to a bottom wall 150 due to a reaction force from the core wire 113. A force to rotate the left wall 151 counterclockwise in FIG. 11 (a direction indicated by arrow A) about a lower edge of a left wall 151 is applied to the left wall 151. A force to the ceiling 153 to open the ceiling 153 upward and a force to rotate the ceiling 153 counterclockwise together with the left wall 151 are applied to the ceiling 153.

A force to rotate a right wall 152 of the slider 116 clockwise in FIG. 11 (a direction indicated by arrow B) about a lower edge of the right wall 152 is applied to the right wall 152.

Figure 12:
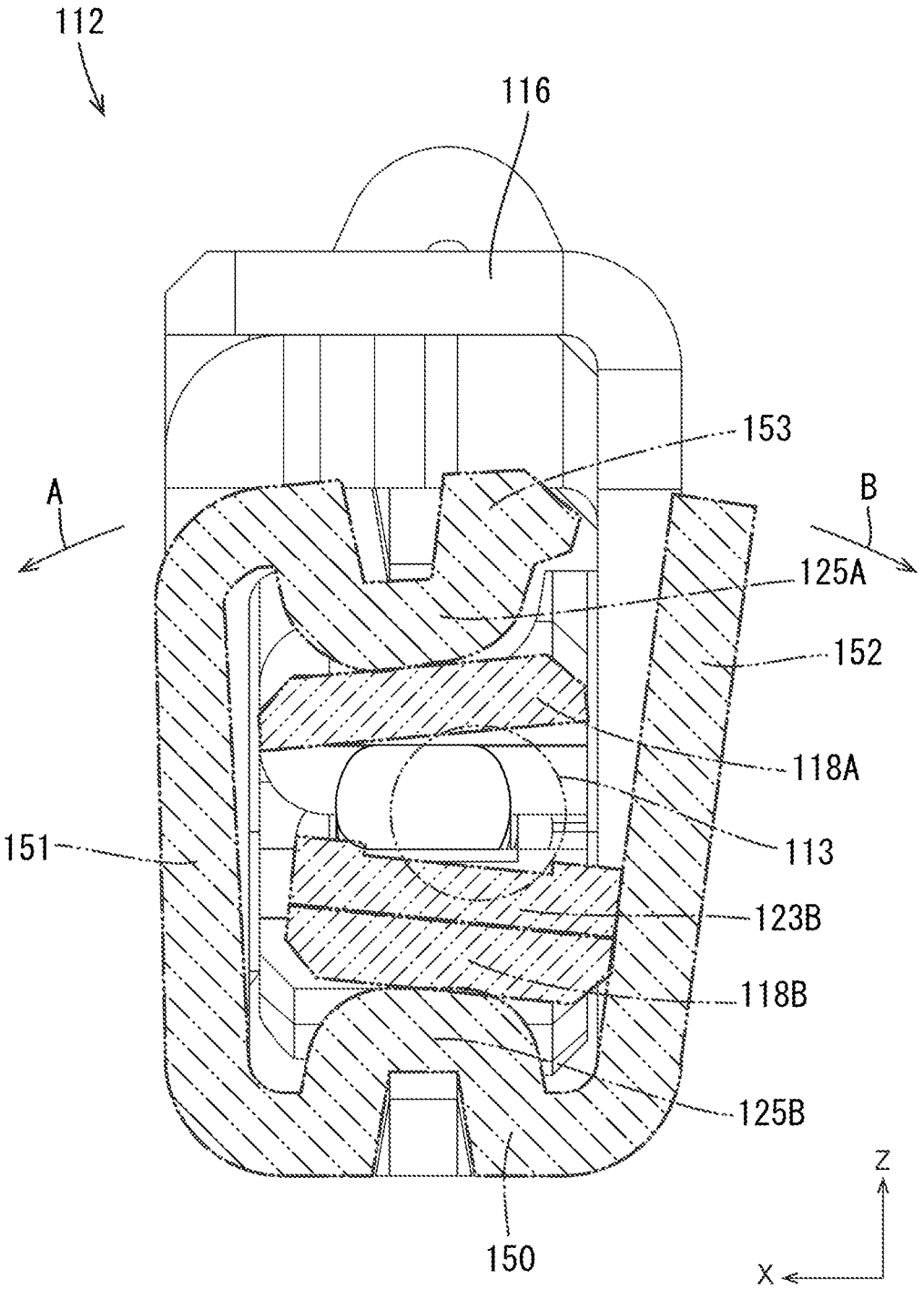
FIG. 12 is a cross-sectional view of a slider that is open according to the virtual technology.

As indicated by a chain double-dashed line in FIG. 12, the slider 116 opens. Specifically, the left wall 151 rotates counterclockwise in FIG. 12 (in the direction indicated by arrow A) about the lower edge of the left wall 151. The right wall 152 rotates clockwise in FIG. 12 (in the direction indicated by arrow B) about the lower edge of the right wall 152. The core wire 113 is displaced from a gap between the upper holding section 118A and the lower holding section 118B. The core wire 113 is no longer held by the upper holding section 118A and the lower holding section 118B with a sufficient force. Therefore, reliability in electrical connection between the core wire 113 and the terminal 112 may decrease.

Operation and Effects of this Embodiment

Next, operation and effects of this embodiment will be described. The terminal 12 of this embodiment is coupled to the electric wire 11. The terminal 12 includes the terminal body 15 and the slider 16. The terminal body 15 includes the upper holding section 18A and the lower holding section 18B that sandwich the electric wire 11. The slider 16 includes the tubular portion 60, the upper pressing portion 25A, and the lower pressing portion 25B. The tubular portion 60 covers the upper holding section 18A and the lower holding section 18B. The upper pressing portion 25A protrudes from the lower surface 61 of the ceiling 53 of the tubular portion 60. The lower pressing portion 25B protrudes from the upper surface 62 of the bottom wall 50 of the tubular portion 60. The upper pressing portion 25A and the lower pressing portion 25B press the upper holding section 18A and the lower holding section 18B toward the electric wire 11, respectively. The tubular portion 60 includes the bottom wall 50, the left wall 51, the right wall 52, the ceiling 53, and the restricting portion 54. The left wall 51 projects upward from the left edge of the bottom wall 50. The right wall 52 projects upward from the right edge of the bottom wall 50. The ceiling 53 extends from the left wall 51 toward the right wall 52. The ceiling 53 is opposite the bottom wall 50. The restricting portion 54 extends from the right wall 52 toward the left wall 51. The restricting portion 54 is over the ceiling 53.

The terminal wire assembly 10 according to this embodiment includes the terminal 12 and the electric wire 11 coupled to the terminal 12.

With the upper pressing portion 25A and the lower pressing portion 25B that protrude from the lower surface 61 of the ceiling 53 and the upper surface 62 of the bottom wall 50 of the tubular portion 60, respectively, large forces are applied from the core wire 13 of the electric wire 11 to the tubular portion 60 via the upper pressing portion 25A and the lower pressing portion 25B. Namely, large outward forces are applied from an inner side to the tubular portion 60 and thus the tubular portion 60 may open. In this embodiment, the restricting portion 54 presses the ceiling 53 from above. Therefore, even when the force to open the ceiling 53 upward is applied to the ceiling 53 from the electric wire 11, the ceiling 53 is less likely to open upward.

In this embodiment, the restricting portion 54 includes the bending section 57 that extends along the left wall 51 and bends toward the bottom wall 50. The left wall 51 includes the receiving recess 58 that receives the bending section 57. The bending section 57 includes the bending-section-holding sections 59 that are fitted to the opening edge of the receiving recess 58.

With the bending-section-holding sections 59 fitted to the opening edge of the receiving recess 58 from below, upward movement of the bending section 57 is restricted. Therefore, upward movement of the restricting portion 54 that includes the bending section 57 us restricted. According to the configuration, upward movement of the ceiling 53 that is under the restricting portion 54 is properly restricted.

In this embodiment, the fitting sections 59 project from the front edge of the lower edge section and the rear edge of the lower edge section of the bending section 57, respectively. According to the configuration, the forces to move the fitting sections 59 in the front-rear direction are evenly received by the opening edge of the receiving recess 58. Therefore, the restricting portion 54 is less likely to deform in the font-rear direction. The reliability in electrical connection between the terminal 12 and the electric wire 11 is less likely to decrease.

In this embodiment, the ceiling 53 includes the fitting tab 56 that protrudes toward the right wall 52 and the right wall 52 incudes the fitting hole 55 that receives the fitting tab 56.

With the fitting tab 56 fitted to the hole edge of the fitting hole 55, the right wall 52 is less likely to open.

In this embodiment, the upper pressing portion 25A protrudes from the ceiling 53.

The ceiling 53 from which the upper pressing portion 25A protrudes to press the electric wire 11 is further less likely to open.

In this embodiment, the slider 16 is slidable in the front-rear direction relative to the terminal body 15.

In this embodiment, the terminal 12 is coupled to the electric wire 11 by sliding the slider 16, that is, with a simple method. This improves work efficiency in coupling of the terminal 12 to the electric wire 11.

Other Embodiments

The present disclosure is not limited to the embodiment described above and illustrated in the drawings. The following embodiments may be included in the technical scope of the technology described herein.

(1) In the above embodiment, the left wall 51 is defined as the first sidewall and the right wall 52 is defined as the second sidewall. However, the right wall 52 may be defined as the first sidewall and provided with the ceiling 53. Further, the left wall 51 may be defined as the second sidewall and provides with the restricting portion 54.

(2) In the above embodiment, the fitting sections 59 projects from the front end and the rear end of the lower edge section of the bending section 57. However, the fitting section 59 that projects from the front end of the lower edge section of the bending section 57 may be included or that projects from the rear end of the lower edge section of the bending section 57 may be included.

(3) The terminal 12 may include only one holding section or three or more holding sections.

(4) The terminal 12 may be a male terminal that includes a male tab.

(5) The bending section 57 may extend along an outer surface of the first sidewall and the fitting section 59 may extend toward the first sidewall and pass through the first sidewall.

EXPLANATION OF SYMBOLS

10: Terminal wire assembly
11: Electric wire
12, 112: Terminal
13, 113: Core wire
14: Insulating sheath
15: Terminal body
16, 116: Slider (an example of shell)
17: Tubular coupling portion
18A, 118A: Upper holding section
18B, 118B: Lower holding section
20: Wire coupling portion
23A: Upper holding protrusion
23B: Lower holding protrusion
25A: Upper pressing portion
25B: Lower pressing portion
26: Temporary receiving hole
27: Permanent receiving hole
28: Holding protrusion
45: Jig
46: Jig contact section
47: Drawing section
50, 150: Bottom wall
51, 151: Left wall (an example of a first sidewall)
52, 152: Right wall (an example of a second sidewall)
53, 153: Ceiling
54: Restricting portion
55: Fitting hole
56: Fitting tab
57: Bending section
58: Receiving recess
59: Fitting section
60: Tubular portion
61: Lower surface of ceiling (an example of an inner ωall)
62: Upper surface of bottom wall (an example of an inner wall)
70: Metal sheet

The invention claimed is:

1. A terminal coupled to an electric wire comprising:
a terminal body including a holding portion holding the electric wire; and
a shell including:
a tubular portion that covers the holding portion; and
a pressing portion that protrudes from an inner wall of the tubular portion to press the holding portion toward the electric wire, wherein
the tubular portion includes a bottom wall, a first sidewall that projects upward from a first side edge of the bottom wall, a second sidewall that projects upward from a second side edge of the bottom wall, a ceiling that extends from the first sidewall to the second sidewall and is opposite the bottom wall, and a restricting portion that extends from the second sidewall to the first sidewall and overlaps an outer surface of the ceiling.

2. The terminal according to claim 1, wherein
the restricting portion includes a bending section that extends along the first sidewall and bends toward the bottom wall,
the first sidewall includes a receiving recess that receives the bending section, and
the bending section includes fitting sections that are fitted to a opening edge of the receiving recess.

3. The terminal according to claim 2, wherein the fitting sections protrude from sides of the bending section in a width direction of the bending section, respectively.

4. The terminal according to claim 1, wherein
the ceiling includes a fitting tab that protrudes toward the second sidewall, and
the second sidewall includes a fitting hole that receives the fitting tab.

5. The terminal according to claim 1, wherein the pressing portion protrudes from at least one of the bottom wall and the ceiling.

6. The terminal according to claim 1, wherein the shell is slidable relative to the terminal body in a direction in which the electric wire extends.

7. A terminal wire assembly comprising:
the terminal according to claim 1; and
an electric wire coupled to the terminal.

8. The terminal according to claim 1, wherein
the holding protrusion includes a pair of a first holding section and a second holding section, each have a protrusion protruding toward an other holding section on opposing surfaces facing each other, and
the first holding section is located at a different position from the second holding section along a tube axis direction of the tubular section.

9. The terminal according to claim 1, wherein an upper surface of the tubular section has a step between one portion and an other portion along a tube axis direction.

* * * * *